US009683813B2

(12) United States Patent
Beckman

(10) Patent No.: US 9,683,813 B2
(45) Date of Patent: Jun. 20, 2017

(54) TARGETING ADJUSTMENTS TO CONTROL THE IMPACT OF BREATHING, TREMOR, HEARTBEAT AND OTHER ACCURACY-REDUCING FACTORS

(76) Inventor: Christopher V. Beckman, New York, NY (US)

( * ) Notice: Subject to any disclaimer, the term of this patent is extended or adjusted under 35 U.S.C. 154(b) by 1289 days.

(21) Appl. No.: 13/615,513

(22) Filed: Sep. 13, 2012

(65) Prior Publication Data

US 2015/0233674 A1 Aug. 20, 2015

(51) Int. Cl.

| | |
|---|---|
| ***G06G 7/80*** | (2006.01) |
| ***F41G 1/46*** | (2006.01) |
| ***F41G 11/00*** | (2006.01) |
| ***F41G 3/12*** | (2006.01) |
| ***F41G 3/16*** | (2006.01) |
| ***F41A 21/48*** | (2006.01) |
| ***F41A 27/22*** | (2006.01) |
| ***F41A 27/24*** | (2006.01) |
| *F41G 3/08* | (2006.01) |
| *F41A 27/04* | (2006.01) |

(52) U.S. Cl.

CPC ..... *F41G 1/46* (2013.01); *F41A 21/48* (2013.01); *F41A 27/22* (2013.01); *F41A 27/24* (2013.01); *F41G 3/12* (2013.01); *F41G 3/165* (2013.01); *F41G 11/00* (2013.01); *F41A 27/04* (2013.01); *F41G 3/08* (2013.01)

(58) Field of Classification Search

USPC ..... 235/407

See application file for complete search history.

(56) References Cited

U.S. PATENT DOCUMENTS

| | | | |
|---|---|---|---|
| 3,991,500 | A | 11/1976 | Kershner et al. |
| 4,020,324 | A | 4/1977 | Buscher et al. |
| 4,108,400 | A | 8/1978 | Groutage et al. |
| 4,179,613 | A | 12/1979 | Koren |
| 4,195,422 | A | 4/1980 | Budmige |
| 4,295,289 | A | 10/1981 | Snyder |
| 4,497,548 | A | 2/1985 | Burris |
| 4,669,809 | A | 6/1987 | Patry et al. |
| 4,745,686 | A | 5/1988 | Willis |
| 4,752,779 | A | 6/1988 | Jones et al. |
| 4,811,308 | A | 3/1989 | Michel |
| 4,895,129 | A | 1/1990 | Hedgpeth |
| 4,965,439 | A | 10/1990 | Moore |
| 4,982,196 | A | 1/1991 | Thomas et al. |
| 4,998,811 | A | 3/1991 | Basta |
| 5,086,567 | A | 2/1992 | Tutsch |

(Continued)

*Primary Examiner* — Jamara Franklin

(57) ABSTRACT

New targeting systems, hardware and techniques are provided. In a preferred embodiment, a system enables a sniper to, in effect, take a projected, trial shot at a subject within an environment, evaluate its effectiveness, and execute it if satisfied. A user may create, set, adjust and execute Impact Point indicators, corresponding with projected points of impact of a projectile on a target subject within a target environment. The system may counteract and otherwise adjust for certain ballistic and environmental factors in a firing mechanism to maintain such an Impact Point fire ready, in real time. Yet the system allows the user to continue to move the sight to engage in further targeting activity.

In other aspects, the system may execute multiple impact points, together or in rapid succession, which impact points may surround, lead, cover or otherwise diversify their distribution about a targeting subject and/or its projected path.

16 Claims, 7 Drawing Sheets

(56) References Cited

U.S. PATENT DOCUMENTS

| | | | |
|---|---|---|---|
| 5,090,805 | A | 2/1992 | Stawarz |
| 5,305,530 | A | 4/1994 | Robertson, Jr. et al. |
| 5,336,899 | A | 8/1994 | Nettleton et al. |
| 5,388,005 | A | 2/1995 | Wilson |
| 5,408,778 | A | 4/1995 | Goodwin et al. |
| 5,495,675 | A | 3/1996 | Huang |
| 5,511,317 | A | 4/1996 | Allen |
| 5,559,551 | A | 9/1996 | Sakamoto et al. |
| 5,651,185 | A | 7/1997 | Vanderheyden et al. |
| 5,707,128 | A | 1/1998 | Dugdale |
| 5,782,002 | A | 7/1998 | Reed |
| 5,824,942 | A | 10/1998 | Mladjan et al. |
| 6,055,046 | A | 4/2000 | Cain |
| 6,069,692 | A | 5/2000 | Stoffberg |
| 6,149,301 | A | 11/2000 | Kautzer et al. |
| 6,192,614 | B1 | 2/2001 | Cliburn |
| 6,237,236 | B1 | 5/2001 | Schnell |
| 6,484,966 | B1 | 11/2002 | Steiner et al. |
| 6,499,247 | B1 | 12/2002 | Peterson |
| 6,499,382 | B1 | 12/2002 | Lougheed et al. |
| 6,614,012 | B2 | 9/2003 | Schneider et al. |
| 6,886,287 | B1 | 5/2005 | Bell et al. |
| 7,100,292 | B2 | 9/2006 | Afshari |
| 7,331,137 | B2 | 2/2008 | Hsu |
| 7,350,329 | B1 | 4/2008 | Bell et al. |
| 7,624,528 | B1 | 12/2009 | Bell et al. |
| 7,703,719 | B1 | 4/2010 | Bell et al. |
| 7,753,549 | B2 | 7/2010 | Solinsky et al. |
| 7,916,895 | B2 | 3/2011 | Johnson |
| 8,094,309 | B1 | 1/2012 | Pochapsky |
| 8,104,217 | B2 | 1/2012 | Huber |
| 8,132,352 | B2 | 3/2012 | Lippard |
| 2001/0017730 | A1 | 8/2001 | Ruh |
| 2001/0037064 | A1 | 11/2001 | Shahidi |
| 2002/0173778 | A1 | 11/2002 | Knopp |
| 2003/0057320 | A1 | 3/2003 | Schneider |
| 2006/0229641 | A1 | 10/2006 | Gupta |
| 2006/0234191 | A1 | 10/2006 | Ludman |
| 2007/0129775 | A1 | 6/2007 | Mordaunt |
| 2007/0240355 | A1 | 10/2007 | Hsu |
| 2008/0000133 | A1 | 1/2008 | Solinsky |
| 2008/0039962 | A1 | 2/2008 | McRae |
| 2008/0043237 | A1 | 2/2008 | Grimm |
| 2008/0092425 | A1 | 4/2008 | Keng |
| 2008/0136916 | A1 | 6/2008 | Wolff |
| 2008/0228078 | A1 | 9/2008 | Kim |
| 2008/0279044 | A1 | 11/2008 | Hafer |
| 2009/0124893 | A1 | 5/2009 | Schlaefer |
| 2009/0199452 | A1 | 8/2009 | Huber |
| 2010/0008539 | A1 | 1/2010 | Johnson |
| 2010/0024274 | A1 | 2/2010 | Lippard |
| 2010/0275496 | A1 | 11/2010 | Solinsky |
| 2011/0010981 | A1 | 1/2011 | Wieland |
| 2011/0242669 | A1 | 10/2011 | Torii |
| 2011/0296699 | A1 | 12/2011 | Mainsonneuve |
| 2012/0105951 | A1 | 5/2012 | Lim |
| 2012/0178053 | A1 | 7/2012 | D'Souza |
| 2012/0180366 | A1 | 7/2012 | Jaroh |

TARGETING ADJUSTMENTS TO CONTROL THE IMPACT OF BREATHING, TREMOR, HEARTBEAT AND OTHER ACCURACY-REDUCING FACTORS

FIELD OF THE INVENTION

The present invention relates to the field of projectile weapons and targeting systems and methods.

BACKGROUND

Projectile-firing weapons have been in use at least since the end of the upper Paleolithic period, when archery (the "bow and arrow") had been invented. A bow is a projectile-firing weapon in which at least one flexible member creates tension in an attached line, which line may be drawn, flexing the member, and then released to propel a projectile known as an arrow by the elastic rebound of the member and line. In modern warfare, firearms and ballistic missiles use propellants to accelerate projectiles at much higher speeds and to strike distant targets, some of which may be difficult, or even impossible, to view with the naked eye. To capitalize on those capabilities and help direct such projectiles to their distant targets, targeting science has been developed.

A wide variety of aiming devices, known as "sights," have been developed, and allow a user to aim a projectile weapon at a target using the user's vision to align the two. For example, a rifle-mounted telescopic sight (a.k.a. "scope") allows a marksman to target distant subjects, typically including the use of optic lenses and a superimposed reticle in the form of crosshairs meeting at a point associated with a point of impact of the projectile ("Impact Point"). Using scopes mounted on high-powered, long-range rifles, highly skilled military and police marksmen, known as snipers, may successfully target and hit subjects at an effective range above 1,000 meters.

However, environmental and user factors can greatly impact the accuracy of rifle and other projectile weapon fire, especially in the instance of ballistic projectiles from hand-held weapons. These factors include, but are not limited to: 1) air density, 2) wind velocity, 3) humidity, 4) visibility, 5) air quality, 6) elevation from subject, 7) ambient temperature, 8) hand and body tremor of the user, 9) shake and misalignment due to trigger pull, 10) flinching due to shot anticipation or environmental activity, 11) movement due to breathing, 12) movement due to heartbeat, 13) errant movements, 14) eye shift not addressed by the sight (parallax effect), 15) environmental structural changes or nudges (e.g., sand bag or tripod sinking, nudge from fellow soldier), 16) changes or states of change of any of the above factors, and 17) subject or other more general environmental movement. At longer firing ranges, the impact of these environmental and user factors, and resulting targeting inaccuracy, can be exponentially amplified. But greater ranges are beneficial, because they allow a sniper to maintain a safe distance from enemy forces and remain undetected. If snipers are located, critical missions may fail, and, in military campaigns, snipers may be captured and assassinated.

Advanced reflecting and collimating sights, such as "red dot" sights, are designed to provide rapid acquisition and targeting with both eyes open and observing the entire environment as well as sight components. Such sights may also reduce or substantially eliminate the parallax effect that occurs when the shooter shifts eye position relative to the reticle of a scope or iron sights.

SUMMARY OF THE INVENTION

New targeting systems, hardware and techniques are provided. In some aspects of the invention, a user of a targeting system may create, set, adjust and execute Impact Point(s) and Impact Point indicator(s), each corresponding with the projected point of impact of a projectile on a target within a target environment. In other aspects, the system may counteract and otherwise adjust for certain ballistic, viewing perspective and projectile accuracy-affecting factors, in a sighting display and in a projectile firing mechanism, while maintaining the influence of others to allow for rapid targeting adjustment, by adjusting their vertical, horizontal, z-axis and rotational positions in real time, to maintain an environmental view, impact point and impact point indicator despite those factors.

In the preferred embodiment, the invention enables a sniper to, in effect, take a projected, trial shot at a subject within an environment, evaluate its effectiveness, and then execute it only if satisfied. Prior to this invention, shots needed to either succeed or fail, with one, actual take—often with disastrous, irreversible consequences.

In other aspects of the invention, the system may execute multiple impact points together or in rapid succession, which impact points may surround, lead, cover or otherwise have a diverse distribution about a targeting subject and/or projected target subject path, based on movement and other environmental factors.

These aspects of the present invention may be applied to a wide variety of other technological fields, including, but not limited to, shipment and inventory tracking and photography.

In still other aspects, a new form of projectile, which implements lift that increases at lower speeds to counteract gravitational drop, while maintaining rifle-driven spiraling, is provided.

RULES OF CONSTRUCTION AND GENERAL NOTES

Within this specification of aspects of the invention, including its embedded definitions, plural and singular constructions may be treated interchangeably unless otherwise indicated in context. Indicated gender pronouns may be treated interchangeably with neutral or other gender pronouns. The exact embodiments disclosed in this specification for carrying out aspects of the invention are not exhaustive of all such embodiments within the scope of the invention. Where applicable, known methods of carrying out tasks and mechanics of the invention may also, or alternatively, be used, and should be considered incorporated into the specification.

DETAILED DESCRIPTION OF THE INVENTION

Figure 1:
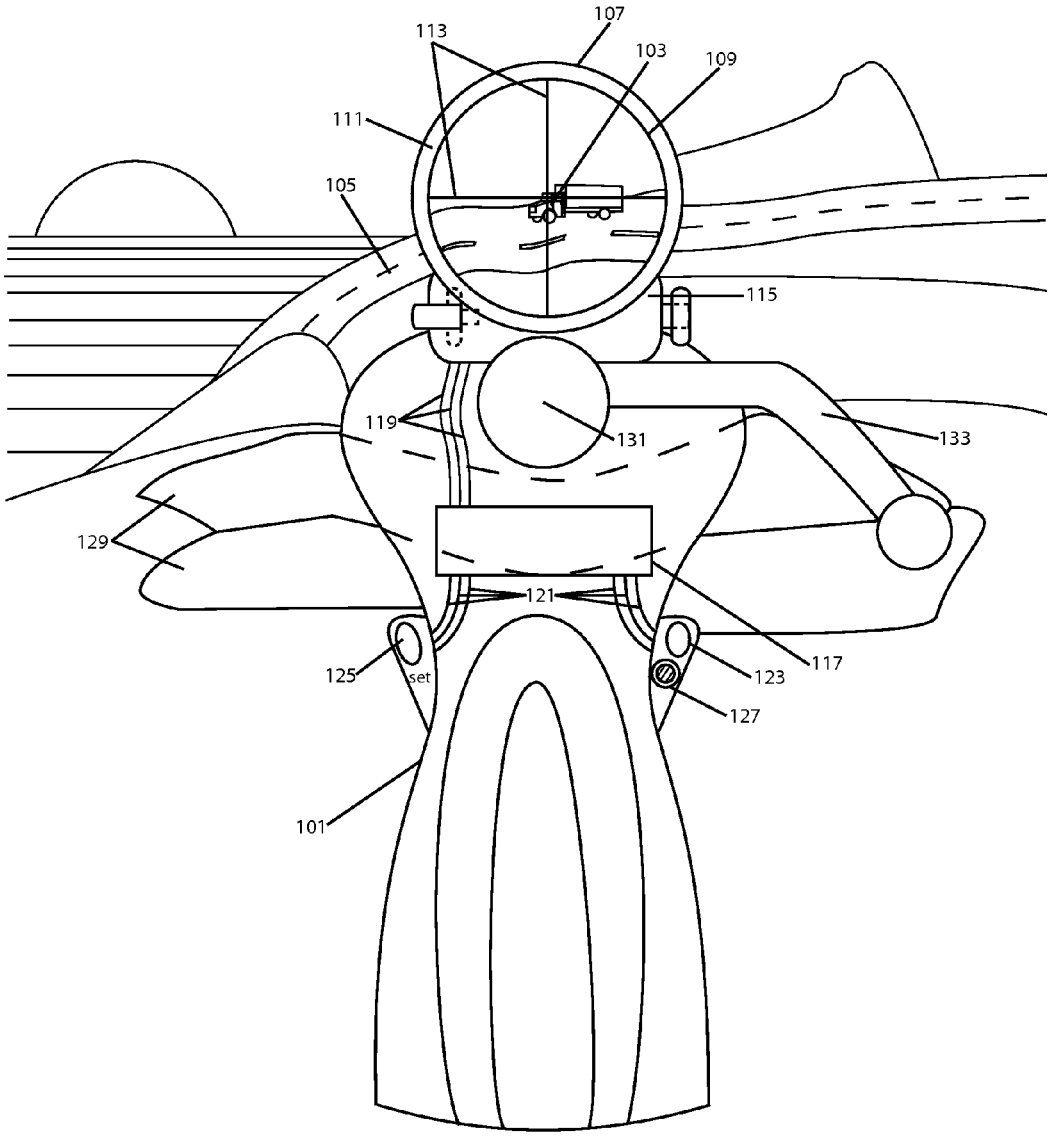
FIGS. 1-4 illustrate a user's perspective of a targeting subject, shooting environment, high-powered rifle with a telescopic sight and other aspects of a targeting system implementing various aspects of the present invention.

FIG. 1 is an illustration from a user's/shooter's ("sniper's") perspective of a targeting subject, shooting environment, high-powered rifle with a telescopic sight and other aspects of a targeting system implementing aspects of the present invention. The rifle, scope, system and some environmental elements in this illustration will be repeated in additional figures, below, to illustrate the operation of aspects of the invention over time. A rifle 101 is trained/aimed in the general area of a subject (in this instance, the driver of a truck) 103 on a distant roadway 105. A telescopic rifle sight ("scope") 107 magnifies the subject 103 and some of the surrounding area, within it's viewing portal 109, which may be enclosed by a cylindrical housing 111 and include a collimating lens assembly and/or electronic viewfinder display features, which may themselves be collimated and variable, and cover or augment the entire field of view of the viewing portal 109, and will be discussed in greater detail below with reference to this and other figures. The electronic viewfinder display aspects of the present invention are capable of creating variably-placed, -sized and -shaped images, including but not limited to virtual images, of a reticle and/or point-of-impact indicating dots and other indicator aspects, which images and/or virtual images may be instantaneously placed, moved, morphed, colored, provided with active lighting ("glow") or otherwise modified. In any event, a more standard, physical reticle with crosshairs 113 may also be included, and may or may not itself be reflecting or collimated to ensure or correct for proper alignment and parallax in target sighting. Crosshairs 113 converge at a point initially generally corresponding with a point of impact of a projectile to be fired from the rifle, but the convergence point may require or be subject to adjustment to account for windage, range, angle/drop vector and other ballistic and/or environmental factors. An electronically actuated variable mounting 115 permits the adjustment of the horizontal and vertical position of the viewing portal 109 and/or the crosshairs 113, and may also allow adjustment of the rotational angle of the scope as may be required for it to remain viewing at least part of a selected target, as will be discussed in greater detail later in this application with respect to certain embodiments, but this aspect need not be included in all embodiments of the invention. Alternatively, a partially or entirely artificial or transposed image viewfinder or other display, such as but not limited to a light-emitting diode (LED or OLED) or other electronic/photonic display aspect(s), may be used to create images in the viewing portal corresponding with a view of at least part of the target environment, in which instance variably-angled sensors or cameras may also be used in place of scope lenses and variable mounting 115 may not be required.

A system including control system unit 117 (which, as discussed with reference to FIG. 5, describing a potential control system that may be used to implement certain aspects of the present invention, may include a processor), may permit the actuation of servo/motors (also not pictured) within the mounting 115, enabling such angle, horizontal and vertical adjustments to the mounting 115 and/or display image output of the viewing portal 109, as necessary to make any of the adjustments required by embodiments of the invention. Preferably, electrical leads 119 allow electronic signal and command communication between the control system unit 117 and mounting 115 and viewing portal 109. Electrical leads 121 further allow electronic communication between the control system unit 117 and various finger- or thumb-actuated user input controls 123-127. Although local, electrical leads are shown in the example provided in the figure, it should be understood that any method of signal and command communication may alternatively be used, including but not limited to electronic or electromagnetic (such as radio frequency) methods of such signaling and communication known in the art. In addition, although the control system unit 117 is shown as physically attached to the rifle and/or other aspects of the system, the control system unit and user controls may be located anywhere where they may make the commands and communications necessary to carry out the aspects of the invention discussed in this application. A remote control unit and/or user controls, and non-human rifle support and control actuation system, along with live feedback from sensors and/or cameras, may also, or alternatively, be used.

The stock or barrel of rifle 101 may be rested on sandbags 129, a tripod, or other stabilizing prop, and/or the shooter's arm (not pictured), for resting the rifle and enhancing physical stability. A bolt action 131 and optional manual reloading bolt lever 133 may be used for chambering cartridges and actuating an angle-variable firing mechanism (not pictured in this figure), including a firing pin and barrel, in accordance with aspects of the present invention, an example embodiment of which is provided with respect to FIG. 6. As will be discussed with reference to FIG. 6, such a firing system will be controlled in its vertical and horizontal position as well as its rotational angle by its own instantaneously adjustable servo/motor mounting(s), as controlled by the control system unit 117. Control system unit 117 generally will instantaneously match the angle of the barrel of the rifle to create a ballistic path that will coincide with at least one point of impact(s) indicated by an Impact Point indicator generated in the viewing portal 109, which point of impact(s) may be selectable and may be multiple and separately created and adjusted, as will be discussed in greater detail below. As also will be described in greater detail below, control system unit 117 will also allow such points of impact, their set indicators (which will be discussed shortly) and barrel training/aiming angles to remain fixed with respect to an external reference point or frame of reference in the surrounding environment, by counteracting and/or addressing movements with respect to such at least one such reference point or frame, for example, with inertial disturbance sensors and/or with sensed and tracked environmental reference points and/or motion projections and/or intercept actions.

The following is a discussion of some of the ways in which the system may be used by a sniper in a staged, deliberate and perfecting manner to separately acquire and fire upon a targeting subject with high precision, while eliminating or reducing many external factors that otherwise would threaten accuracy. First, as shown in FIG. 1, the user/shooter brings the target and at least part of a general surrounding area into the viewing area of the viewing portal 109. It should be noted, however, that the system may sense, image, record and track more of the surrounding environment, including the location of impact points beyond that area visible in the viewing portal 109. At this point, the system 117 need not actuate mounting 115 nor alter the shooting angle of the rifle firing mechanism or barrel, but the user or system may adjust the scope for windage, range and other ballistic variables as in conventional rifle scopes, and the rifle and scope and system may, in fact, operate in a mode in which it may fire as an ordinary rifle, with any such routine scope adjustments. However, provided that the sniper has sufficient time and wishes to eliminate certain accuracy-threatening factors, the user may proceed to additional aiming and target acquisition steps. For instance, the sniper may next press the "New Impact Point" creation button 123, preferably with his or her index finger and in a button location separate from the firing trigger (not shown), as pictured. However, in an alternative embodiment, a partial trigger compression or "pull" may itself serve to create a New Impact Point to be displayed on the viewing portal 109. Assuming that the user has done so, by either embodiment, we will proceed to discuss the effects of creating a New Impact Point for display in FIG. 2.

Figure 2:
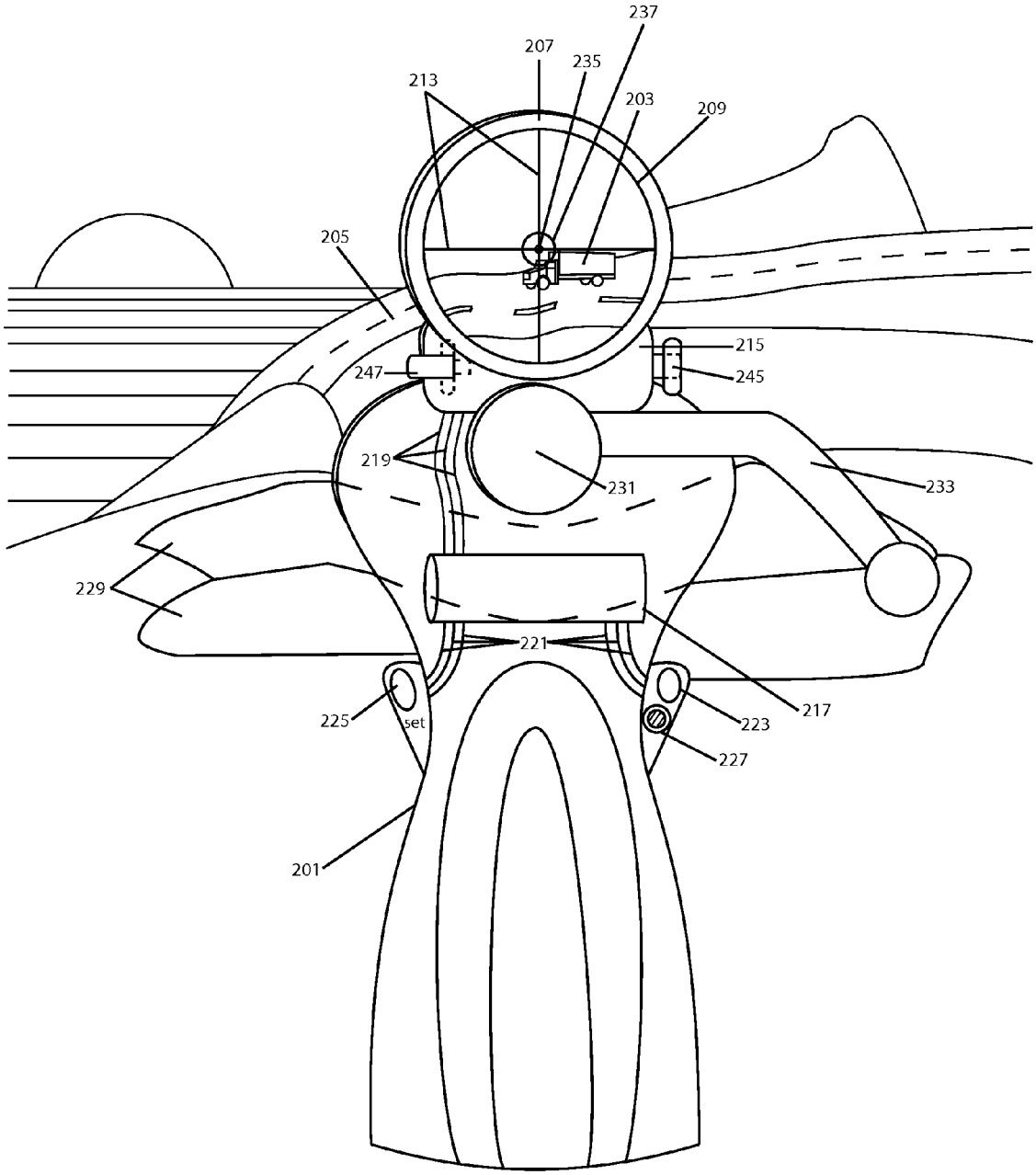

FIG. 2 is an illustration from the same perspective of the same targeting subject, shooting environment, high-powered rifle with a telescopic sight and other aspects of a targeting system as discussed with reference to FIG. 1, now implementing additional aspects of the present invention. Carrying the discussion forward from FIG. 1, the latest step that the sniper undertook was to introduce a New Impact Point and New Impact Point indicator into the viewing portal. FIG. 2 illustrates the instant that such a New Impact Point and indicator were created, and the New Impact Point is shown as an illuminated dot 235 which, together with a concentric circle 237 surrounding the dot as its center, serve as a New Impact Point indicator. The New Impact Point indicator shown as 235 and 237 is created by display aspects of the viewing portal, now shown as 209, such as an electronic display output, electronically connected to the control system unit, now 217. The New Impact Point aspect 235 was created and appears directly in the center of the crosshairs, now 213, of the reticle and, in the instant of its creation, the New Impact Point 235 and the convergence of the crosshairs 213 each correspond with a point of impact of a projectile to be fired from the rifle assuming that the control system unit and/or user has correctly addressed all relevant ballistic factors. Due to user or environmental factors, however, such as breathing, hand shake, heartbeat, loss of grip, nudging, or support subsidence, for example, just before creation of the New Impact Point, both the reticle crosshairs 213 and the New Impact Point indicator have, at least temporarily, been placed by the user slightly off target, to the upper-left-hand side of the of the intended subject, the driver of the truck, rather than on or closer to the subject's vicinity.

According to some embodiments of the present invention, in creating and/or maintaining the New Impact Point and New Impact Point indicator, additional aspects of which will be discussed in greater detail below, a system, including but not limited to the control system unit 217, may account for and apply ballistic and other projectile path correction functions to correct for or address any or all of the factors affecting or potentially affecting the accuracy of the New Impact Point indicator at indicating a point of impact of a projectile on a target, if and when it is fired from the rifle. The potential influence of such factors may be sensed by sensors (not pictured) which feed data to the system, such as, but not limited to, wind velocity, altitude, shot angle (and corresponding gravity vectors causing projectile drop over the range of a shot fired), barometric pressure, air temperature, humidity, environmental nudging or hand shake—such that position correction and/or intercept algorithms and/or functions may be applied to servo/motors, solenoids or other actuators controlling both the training angle of the firing mechanism/barrel and the scope, as necessary to maintain firing capability on an impact point and maintain the New Impact Point indicator and target within the field of view of the scope. However, preferably, at this stage (New Impact Point created but not yet set), human and other environmental movement variables are allowed to continue to move the scope, reticle and New Impact Point indicator while the system adjusts only the firing mechanism and barrel angle to maintain a set point of impact at the location corresponding with the New Impact Point, as it may move with the user's hand or other aiming movements. This preferred embodiment will be further illustrated, and discussed in greater detail, with respect to later figures.

To aid the system in counteracting gravity vectors causing projectile drop over the range of a shot fired, a specialized form of projectile may also be used, which eliminates or greatly reduces the increasing rate of bullet drop over the flight path of most ballistic projectiles unpowered during some part of flight. Specifically, such a projectile includes lift-creating elements, at least one of which creates a drafting effect on another element, blocking or reducing some of the lift-producing airflow on that another element. As the projectile experiences drag in flight, and reduces its speed, at later points in its flight, the influence of gravity is more greatly offset in such a projectile, by increased airflow and lift on that another element. To maintain fixed, as opposed to spinning, airflow elements, an internal gyro aspect, which may spin within a housing including such airflow elements, may be included, which gyro may be caused to spin by a rifling or other spin-inducing element of the firing mechanism and/or projectile, increasing the projectile's stability. For rifling to induce such spin, access port(s) and/or access grooves in the housing may be included, allowing rifling to engage the gyro unit, or some tab or aspect thereof, to cause it to spin, while straight-line leveling grooves engage the lift-producing elements, or another housing element, to produce rotationally stabilized, or level flight in the housing.

Turning back to the embodiment illustrated in FIG. 2, the sniper may next choose to "set" the location of the New Impact Point, for example, using the impact point set button 225. If so, the current location of the New Impact Point and its indicator (relative to the target environment, or represented target environment) would become fixed, at least, depending on the embodiment, with reference to the shooting subject- or system-surrounding environment but may also, or alternatively, be fixed on the subject even if it moves by tracking, location projection, "painting" the subject or by other tracking, projection or intercept method. However, because the New Impact Point has been placed in an off location, due to user and/or environmental factors, the user may instead wish to cancel the New Impact Point, using the impact point cancellation button 227, returning the system to the state shown in FIG. 1, such that the sniper can again attempt the correct placement of a New Impact Point on the subject. Alternatively, the user may instead tweak the placement of the New Impact Point to further set it, by using Impact Point vertical and horizontal adjustment controls, such as vertical and horizontal adjustment knobs 245 and 247, respectively, to better set the location of the New Impact Point and indicator. In some embodiments, depressing the cancellation button 227 at any point may reverse the previous step entered by the user in the system.

Assuming that the sniper has successfully created a New Impact Point and indicator on or near the subject, as desired, using the steps and adjustment process discussed immediately above, the figures below address further aspects of the present invention.

Figure 3:
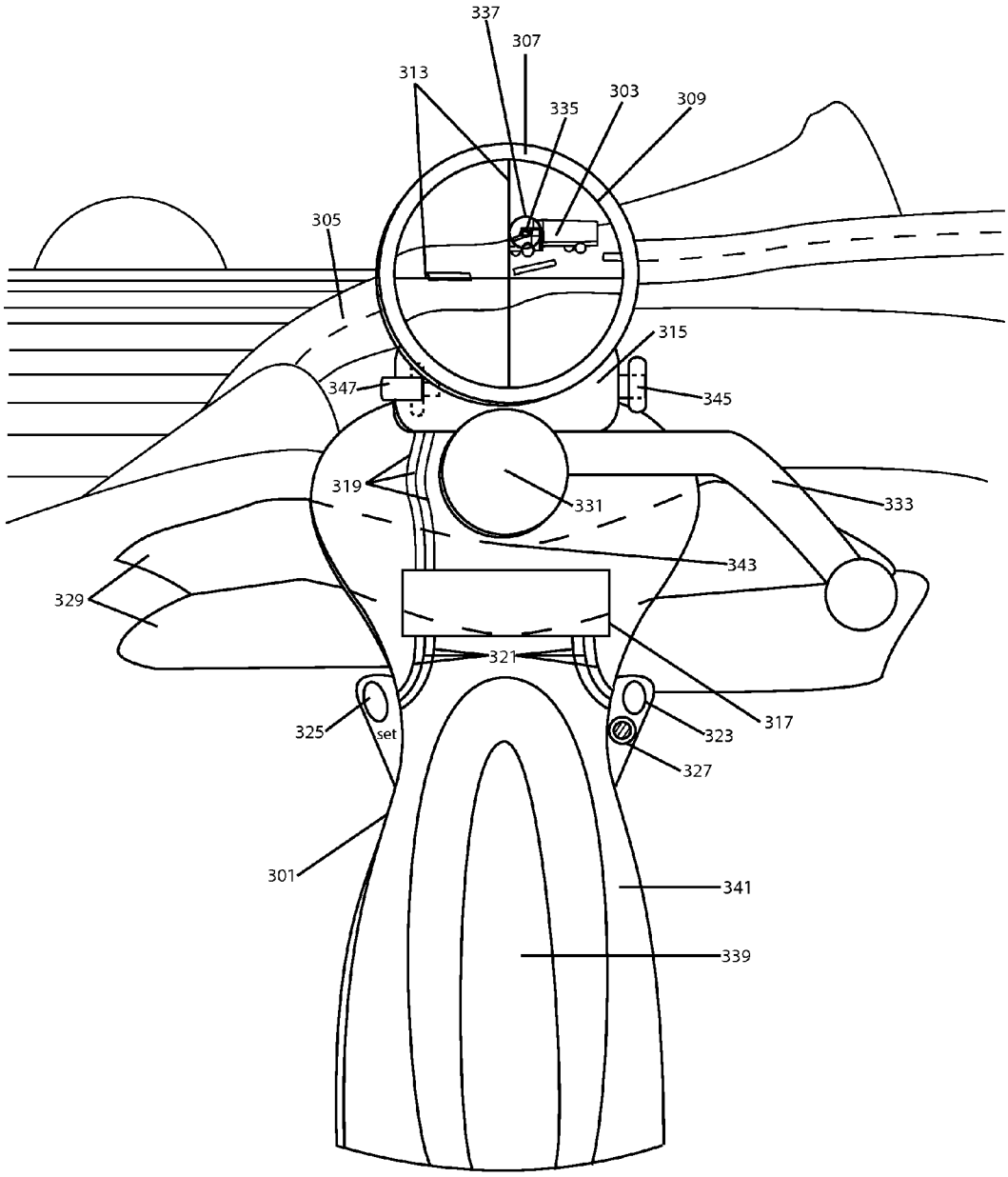

FIG. 3 is another illustration from the sniper's perspective of the same targeting subject, shooting environment, high-powered rifle with a telescopic sight and other aspects of a targeting system as discussed with reference to FIGS. 1 and 2, but at a later point in time, and implementing additional aspects of the present invention. In the instance in time shown in FIG. 3, user and/or environmental variables have caused the rifle 301 to be further moved with reference to the subject driver of truck 303. Specifically, the stock and handgrip 339 and 341 (each of which are closer to the sniper's chest and rifle-actuating hand than the pivoting point 343 of the rifle 301 on the sandbags 329 on which the rifle is resting) may have been budged slightly upward and to the right, from the perspective of the figure. That movement caused the scope, which is closer to the pivoting point of the rifle on sandbags 329, to shift its angle and point more to the left and downward. As shown in the figure, the system nonetheless maintains the New Impact Point and its indicator, now 335 and 337, in their set location relative to the subject and/or surrounding environment, which may be accomplished by location beacon, inertial change detection or subject movement tracked position projection, or other methods of sensing the movement and the attendant change in position of the scope relative to that subject and set impact point, and moving the New Impact Point indicator as it appears within the scope to remain indicating its correct placement on the subject, within the subject environment and/or weapon environment. In addition, the system may actuate the firing mechanism position, including the barrel, to shift it vertically and horizontally and in its angle such that a projectile fired from the rifle would have a point of impact corresponding with the location of the New Impact Point and its indicator, relative to the subject and/or environment also including any instantaneous adjustments necessary for any other accuracy impacting factor, as well as the movements discussed above, as may become necessary by changes or introduction of such factors. In the preferred embodiment shown in the figure, the system did not, however, completely counteract the movement using variable mounting 315 to alter the location of the scope housing and reticle and, in fact, such a mounting may have restricted actuation to address certain but not all accuracy-affecting factors, or may, instead, be fixed and not actuable, or may be actuable only for general use and initial set-up of the scope on the rifle (which may be prior to the targeting activity, and therefore address general factors but not more immediate, dynamic user and environmental factors). For example, prior to training the rifle and scope on a particular subject, the sniper and/or system may adjust the scope using variable mounting 315 to address the influence of elevation, humidity, air pressure, and windage, but hand and body movements impacting the rifle, and even hand shake, and other environmental collisions with the rifle, may be permitted to move the scope generally.

Accordingly, the rifle scope generally has been allowed to shift and change its angle with the user or environmental movement discussed above, and now points, along with the reticle, downward and to the left of the subject, rather than directly at it. Nonetheless, due to the active, instantaneous maintenance of the set New Impact Point and its indicator appearing at the location of the subject, counteracting the present and/or future projected influence(s) of accuracy-affecting factors on the indicator and firing mechanism, a sniper firing the rifle at any time after setting a New Impact Point and indicator will result in firing a projectile that will accurately impact the subject location, despite those otherwise accuracy-impacting factors. By allowing rifle movement to continue moving the scope, and altering the view in the viewing portal, at the same time as maintaining the New Impact point, indicator, and firing mechanism, however, the sniper is able to continue scanning and evaluating more of the environment, and may set new impact points in new locations, selecting each for well-timed execution. This embodiment is preferred due to this versatility with high accuracy. It is also preferred because it enables a sniper to, in effect, take a projected, trial shot at a subject within an environment, evaluate its effectiveness, and then execute it only if satisfied. Prior to this invention, shots needed to either succeed or fail, with one, actual take often with disastrous, irreversible consequences.

In other embodiments, the scope and/or reticle itself may continue to indicate the point of impact by moving, along with the servo/motor actuated barrel, to counteract any and all user and environmental factors impacting accuracy—rather than remain fixed with respect to, and moved by, some user or environmental factors, as in the preferred embodiment above. In such embodiments, by selecting a New Impact Point, the crosshairs themselves, or some part thereof, may change shape, color, active lighting, or other indicating characteristics to signify that such a new impact point has been created. Such indicating characteristics, but of a different nature, may separately indicate new, additional Impact Points and the setting or priority status(es) thereof, and additional reticles may also be added, to address those new impact points, in which case the scope may follow (centered on) the latest new impact point or highest priority N.I.P. with a corresponding reticle, instead of or in addition to another impact point indicator or component thereof, such as those discussed above, unless and until the setting of another impact point has begun.

Assuming that the sniper has not yet executed a command to the system (e.g., by full trigger pull) to execute the Impact Point that was set, and shown by the Impact Point Indicator 335 and 337, the user may, of course, cancel the impact point or tweak its location, using the user controls as discussed above. However, the user may also choose to set an additional New Impact Point and indicator, aspects of which will be discussed in greater detail with reference to FIG. 4, below.

Figure 4:
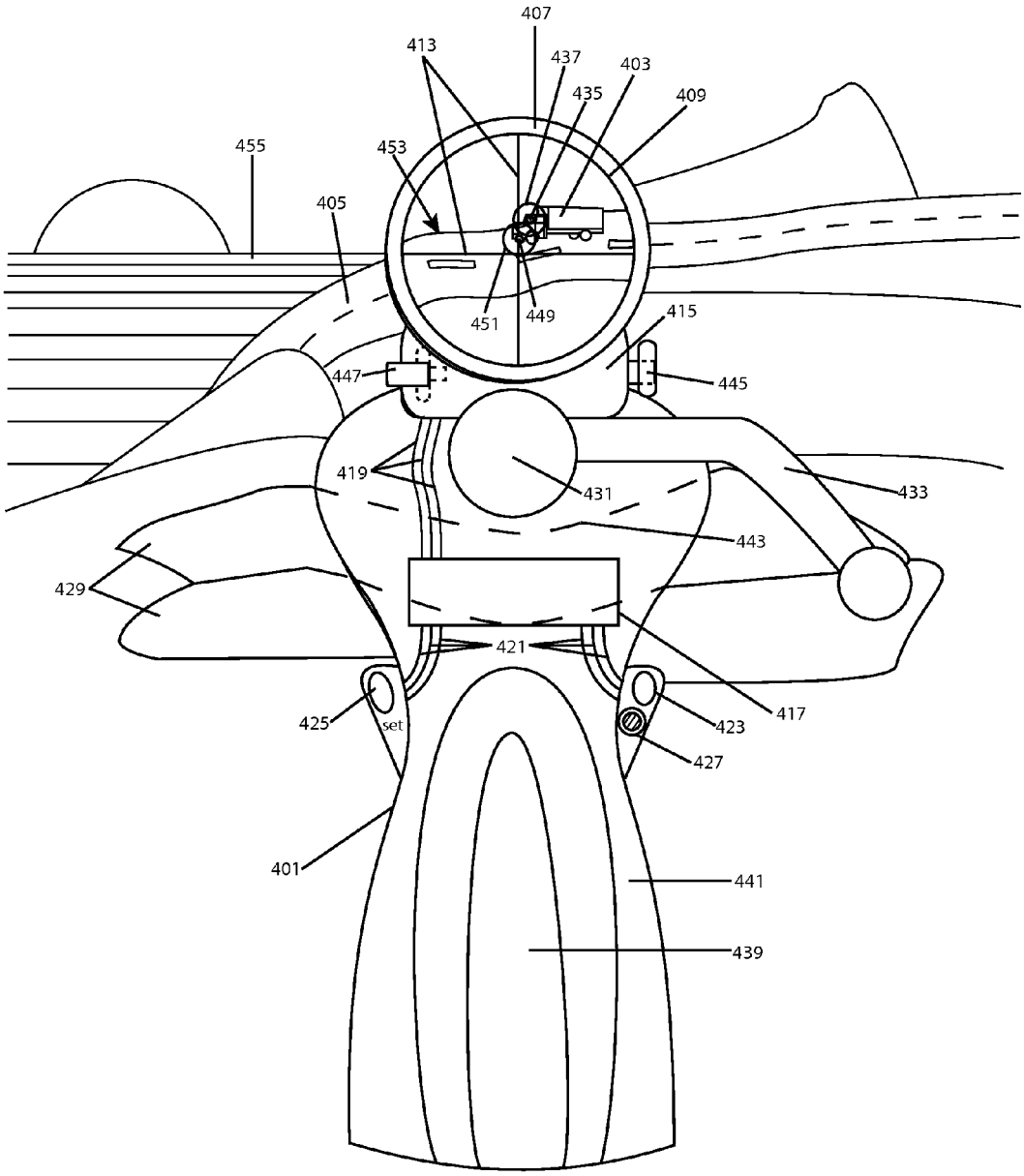

FIG. 4 is another illustration from the sniper's perspective of the same targeting subject, shooting environment, high-powered rifle with a telescopic sight and other aspects of a targeting system as discussed with reference to FIGS. 1-3, but at a still later point in time, and implementing additional aspects of the present invention. In FIG. 4, another New Impact Point and indicator have been created and set, shown by New Impact Point indicator dot and surrounding concentric circle 449 and 451. A sniper has used the process discussed above, with respect to creating the previous impact point and indicator, which still exists and is now shown as 435 and 437, to create the additional New Impact Point and indicator shown as 449 and 451. More specifically, the sniper has created and set the New Impact Point and indicator at a location corresponding with an Impact Point at the front, right tire of the truck 403, from the perspective of the driver, near the edge of the road 405 and a cliff 453 descending into a body of water 455.

If a sniper then chooses to execute one or both impact points, the system would first cause the impact point selected for first execution ("highest priority") to be hit with a projectile, by actuating the firing mechanism as described above for maintaining aim (including offsetting all environmental and user accuracy-impacting factors) and firing upon ("executing") an impact point. If the user then commanded the system to execute the second impact point, the system would then actuate the firing mechanism to cause a projectile to hit the second impact point, e.g., by repositioning the barrel (aiming it) to do so, accounting for all factors impacting accuracy. In some aspects of the present invention, the system may rapidly execute firing upon each impact point without pausing to allow the rifle to settle after recoil, and further counteract the impact of recoil as another accuracy-impacting factor. But in other aspects, the system may pause to allow such settling, or, at least, part of such settling, to retain firing capability within the range of possible firing mechanism adjustments. Different modes may be available to permit the user to fire upon all impact points set, or to "double-tap" or otherwise produce a close grouping, coverage of possible locations of a target, or other patterns of multiple shots with an automatic rifle on or about an impact point or series of impact points, which actions may be executed upon one command (e.g., one trigger pull). But serial execution (one impact point per trigger pull or other command from highest to lowest priority—which may be rearranged by the user) after recoil settling and determining that the impact point is still within the viewing portal, which may correspond with being executable by the system, may be preferred for some sniping applications, and may also be used in executing such patterns.

The targeting methods and systems set forth in this application may apply equally to a wide variety of other pointing, aiming, targeting and executing activities, including, but not limited to, cameras and electronic tagging or data write/re-write activities. For example, shipment tracking systems and high-speed photography systems may create multiple targeting (impact points) for focused activities using the same types of controls and a similar GUI (e.g., photographic viewfinder rather than reticle), but for intercepting a point or area with a tracking (scanning, reading, writing) or photographic activity.

Figure 5:
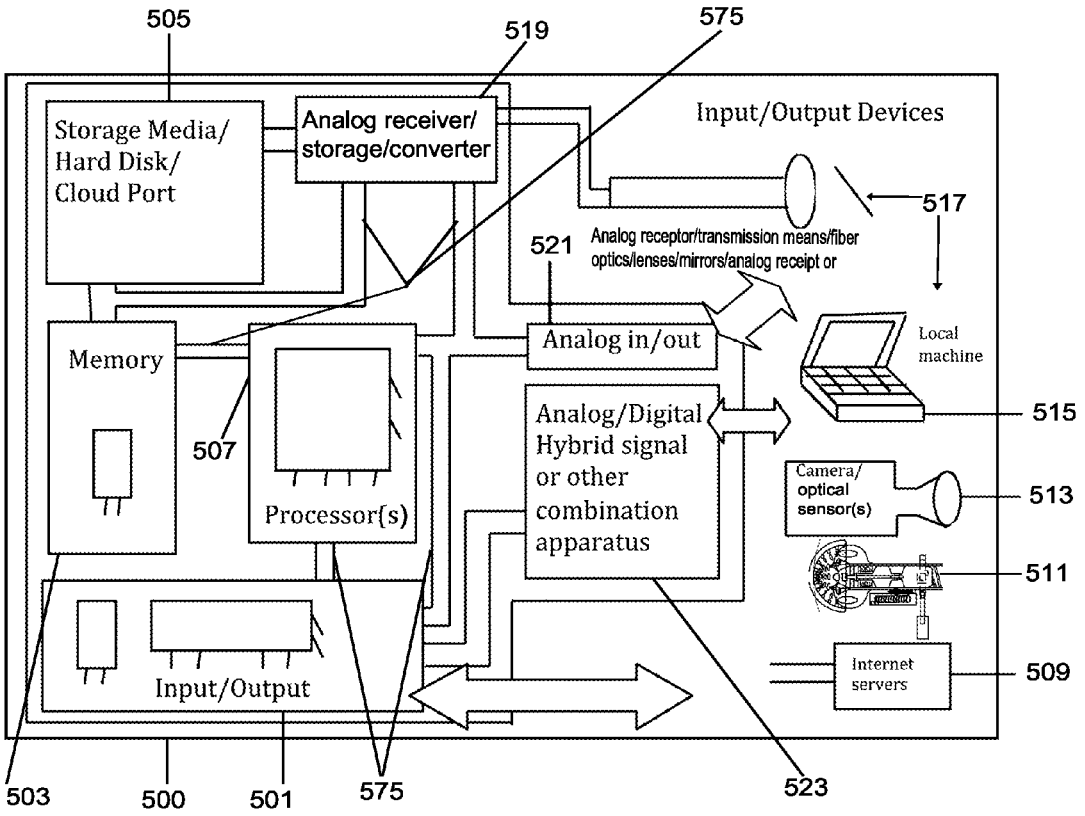
FIG. 5 is an illustration of control system, as may be used to assist in implementing various aspects of the present invention.

FIG. 5 is a schematic block diagram of some elements of a control system 500, preferably incorporating a machine-readable medium, that may be used to implement various aspects of the present invention, other elements of which are depicted in FIGS. 1-4 and 6 and 7. The generic and other components and aspects described herein are not exhaustive of the many different systems and variations, including a number of possible hardware aspects and machine-readable media that might be used, in accordance with the invention. Rather, the system 500 is described here to make clear how aspects may be implemented.

Among other components, the system 500 includes an input/output device 501, a memory device 503, storage media and/or hard disk recorder and/or cloud storage port or connection device 505, and a processor or processors 507. The processor(s) 507 is (are) capable of receiving, interpreting, processing and manipulating signals and executing instructions for further processing and for output, pre-output and/or storage in and outside of the system. The processor(s) 507 may be general or multipurpose, single- or multi-threaded, and may have a single core or several processor cores, including microprocessors. Among other things, the processor is capable of processing signals and instructions for the input/output device 501, analog receiver/storage/converter device 519, and/or analog in/out device 521, to cause a user interface to be provided or modified for use by a user on hardware, such as, but not limited to, physical human hand tracker and other human body part interface controls (e.g., 3-D hand sensor, object emulator, joystick control, sight or scope adjustment dials) and/or a personal computer monitor or terminal monitor with a mouse and keyboard and presentation and input software (as in a GUI), rather than or in addition to electronic/photonic scope or sight aspects, as discussed in reference to other figures in this application.

For example, a "window" presentation user interface aspect may present a user, such as a sniper, with a reticle and/or environmental image, remaining scope readouts or display output, with selectable menu options in a GUI, to select settings for targeting and execution, such as creating, cancelling and adjusting New Impact Points, or the counteraction or other treatment of factors impacting the accuracy of a firing mechanism, as discussed in greater detail elsewhere in this application.

As another example, such a "window" presentation user interface aspects may present a user with the option to target or gesture with respect to particular locations of visual emulations of a model or photographic subject, based on live feedback, such as imaging and the detected movement of painted or edge/boundary detected targets within a collateral medium or material. As another example, the user interface and hardware may allow a user to manipulate a virtual object that may translate movements into control input matching or related to those movements in real time, and with reference to a live model depicted on a computer monitor and presenting instantaneous information from a radar or sonar or Nuclear Magnetic Resonance Imaging ("MRI") or X-ray radiographic (e.g., CAT scan) machine, which may allow a user to create an activity or apply physical force or energy to particular areas of a target, in particular series, locations, shapes and sizes or pulses and pulse rates to substantially cut or ionize matter, which size and shape may be given a hardness of edge, tolerance, and strength, all individually controllable by a user, and which may be provided as feedback to the user by acceleration of the virtual object, either by an actuable effigy of the shape, size, position, resistance and weight of the virtual object and its controls, or by tactile stimulus (e.g., ultrasound and/or radiative feedback). A virtual object or other ionizing tool may include a shaped cursor which may be semi-transparent, and may allow the user to plan and view a portrayed path for the planned future ionization or other, for example actual, robotically actuated physical movement, such as surgical lancing or other subject manipulation, before it is actually implemented on a subject (which execution can be done in parts or degrees or completely, with a separate, later command to the system). This manipulation path planning may be done with a cursor or other display, such as a computer monitor, or depiction/control hardware and techniques (e.g., 3-D physical contour, camera array projection, cutting, shipment tracking plan, or manipulation emulation device). In any event, a user may create a path of planned movement, shooting or a shooting series, tracking protected subject location or path intercept or other activity or other manipulation by programming such a path and/or by first executing the path in virtual or real space and, optionally, reviewing a depicted path based on that execution, and, if satisfied with the characteristics of the movement(s) of the executed path (e.g., direction(s), length(s), instance(s), location(s), coverage(s), breadth(s), pressure(s), actual or real tissue reaction(s), size(s) of lancing or projected lancing, or blunt instrument trial or projection of where lancing or other actuation will take place), all of which characteristics may be displayed numerically or graphically as an attribute of a depicted path in a display as a "Planned Path," representation, the user may then choose to have the path executed. Optionally, before choosing to execute the path, the user may choose to save a file composed and capable of executing the characteristics of the movement on the system. Also optionally, the user may elect to modify individual, several or all characteristics of the path over any part of the path's progression (for example, by creating or manipulating segmentation tools such as anchor points along the path), again may choose to save such a file comprised of such information, and again may choose separately to execute the path, which may be executed at different speeds along the path or even with a graduated and/or matched acceleration device, such as a throttle for the path's execution speed (using any possible units/time) which may be stopped at any time during observation of the movement. The system may automatically, or at the user's direction, adjust the path or path segments for unintended hand tremor by smoothing or substituting more graduated curves and movement accelerations along progressions or as to characteristics of the path. The system may automatically, or a user may direct it, to generate reactive or protective radiation in greater, lesser or other amounts that better interfere and protect against ionizing radiation, for protected collateral areas, as well, as another example, based on live feedback concerning the amount of protection actually occurring through interference, as sensed by the system, and/or based on physical models, including refraction models.

The processor(s) 507 is/are capable of processing instructions stored in memory devices 505 and/or 503 (or ROM or RAM), and may communicate via system buses 575. Input/output device 501 is capable of input/output operations for the system, and may include and communicate through numerous input and/or output hardware, and numerous instances thereof, such as, but not limited to, a computer mouse, touch screen, flat panel display, collimating light-augmented scope, and pixel arrays, including a pixel array with differently addressable and separately (or in any progressive or other sub-group) scannable and projectable pixels, system element position sensors and actuators (as in 511, which may be the system described in FIG. 6, but should be understood to include such actuators and sensors for carrying out the capabilities described aspects of the invention described in that figure), firing mechanism position sensors and actuators (also as in 511), MRI machine, X-Ray radiography device, robotic actuator(s), magnetic field creators or modifiers/oscillators (and magnetically-actuated, locatable particles, such as nano-particles, or manipulation devices that are systemically or locally available in patients, e.g., nano-particles with abrasive surfaces that may spin, expand, grab, cauterize through electric charge, in an oscillating magnetic field and that may also react to markers on targets, available through injection into the patient), communications antenna, electromagnetic radiation source(s), keyboard, networked or connected second computer, camera or scanner, a multi-tiered information storage device (including its actuators and read/write apparati), mixing board, real-to-real tape recorder, external hard disk recorder, additional movie and/or sound editing system or gear, speakers, external filter, amp, preamp, equalizer, computer display screen or touch screen. It is understood that the output of the system may be in any perceptible form. Any such display device or unit and other input/output devices could implement a program or user interface created by machine-readable means, such as software, permitting the system and user to carry out the user settings and input discussed in this application. 501, 503, 505, 507, 519, 521 and 523 are connected and also able to communicate communications, transmissions and instructions via system bus(ses) 575. Storage media and/or hard disk recorder and/or cloud storage port or connection device 505 is capable of providing mass storage for the system, and may be or may include a computer-readable medium, may be a connected mass storage device (e.g., flash drive or other drive connected to a U.S.B. port or Wi-Fi) may use back-end (with or without middle-ware) or cloud storage over a network (e.g., the internet) as either a memory backup for an internal mass storage device or as a primary memory storage means, or may simply be an internal mass storage device, such as a computer hard drive or optical drive. Generally speaking, the system may be implemented as a client/server arrangement, where features of the invention are performed on a remote server, networked to the client and made a client and server by software on both the client computer and server computer.

Input and output devices may deliver input and receive output by any known means, including, but not limited to, the examples shown with respect to examples 517. The input managed and distributed by the system may be any representational aspect or signal or direct impression captured from any sensed or modeled activity, and may be taken or converted as input through any sensor or carrier means known in the art. In addition, directly carried elements (for example a light stream taken by fiber optics from a view of a scene) may be directly managed, manipulated and distributed in whole or in part to enhance output, and whole ambient light information may be taken by a series of sensors dedicated to angles of detection, or an omnidirectional sensor or series of sensors which record direction as well as the presence of photons sensed and/or recorded, and may exclude the need for lenses (or ignore or re-purpose sensors "out of focal plane" for detecting bokeh information or enhancing resolution as focal lengths and apertures are selected), only later to be analyzed and rendered into focal planes or fields of a user's choice through the system. For example, a series of metallic sensor plates that resonate with or otherwise detect photons propagating in particular directions would also be capable of being recorded with directional information, in addition to other, more ordinary light data recorded by sensors. While this example is illustrative, it is to be understood that any form of electromagnetism, compression wave or other sensed phenomenon may include such sensory, directional and 3D locational information, which may also be made possible by multiple locations and/or angles of sensing, preferably, in a similar or measurably related, if not identical, time frame. The system may condition, select all or part of, alter and/or generate composites from all or part of such direct or analog image transmissions, and may combine them with other forms of image data, such as digital image files, if such direct or data encoded sources are used. Specialized sensors for detecting the presence of interference or resonance of radiation of any type, and imaging the sources or capturing the forces applied based on the known characteristics of waves and electromagnetic radiation in particular, may also be included for input/output devices. Sensors that permit the biangulation or triangulation of light sources, to determine subject and subject environment location and range information, may also be used, and the system may "paint" any part of that subject or environment with electromagnetic, radiative heating, or other markers to ease tracking, targeting, and counteracting environmental/system relative shifts and rotations with the further use of sensors detecting such markings, as discussed in other parts of this application. A direction-indicating beacon may also or alternatively be planted in the surrounding environment to ease these system activities and general system position and subject tracking assessment, including, but not limited to, subject, target and system position projection, in the environment. In this way, impact points may be placed and maintained relative to the subject itself, if marked, or the environment in general.

While the illustrated system example 500 may be helpful to understand the implementation of aspects of the invention, it is to be understood that any form of computer system may be used—for example, a simpler computer system containing a processor for executing instructions and a memory or transmission source. The aspects or features set forth may be implemented with, and in any combination of, digital electronic circuitry, hardware, software, firmware, or in analog or direct (such as light-based or analog electronic or magnetic or direct transmission, without translation and the attendant degradation, of the image medium) circuitry or associational storage and transmission, as occurs in an organic brain of a living animal, any of which may be aided with external detail or aspect enhancing media from external hardware and software, optionally, by networked connection, such as by LAN, WAN or the many connections forming the internet. The system can be embodied in a tangibly-stored computer program, as by a machine-readable medium and propagated signal, for execution by a programmable processor. The method steps of the embodiments of the present invention may be performed by such a programmable processor, executing a program of instructions, operating on input and output, and generating output. A computer program includes instructions for a computer to carry out a particular activity to bring about a particular result, and may be written in any programming language, including compiled and uncompiled and interpreted languages and machine language, and can be deployed in any form, including a complete program, module, component, subroutine, or other suitable routine for a computer program.

Figure 6:
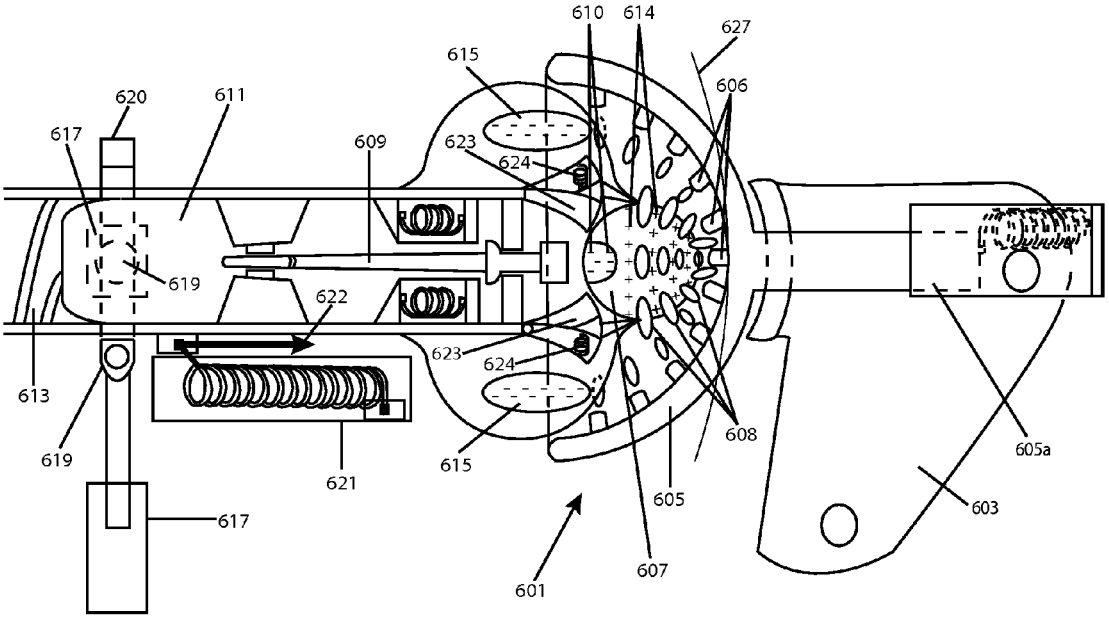
FIG. 6 is a cross-section illustration of a horizontal, vertical and z-axis position-adjustable and rotational angle-adjustable firing mechanism for a firearm, as may be used to implement various aspects of the present invention.

FIG. 6 is a cross-sectional illustration of a horizontal and vertical position- and rotational angle-adjustable firing mechanism 601 for a firearm, as may be used to implement various aspects of the present invention. The cross-sectional plane is vertical and bisects the barrel and remaining firing mechanism as they would appear if the weapon in which they are installed was in firing position, as shown in FIGS. 1-4, creating a view of the right-hand side of the two bilaterally identical halves of the barrel and each other firing mechanism component, with the exception of one component, (a spherical striker, 607) to ease its presentation, is a simple side-view of that part.

A hammer 603 may be included and may be force-biased and caused, upon a shooting execution movement (which may be electronically commanded and/or physically caused) to release stored energy from that force biasing and strike a preferably semi-spherical concave intermediate gear 605 which is physically interfaced with an abutting convex curved, and preferably spherical, striker 607, via gear teeth, such as those shown as 606 and 608. A firing operation embodiment, using the firing mechanism described in this figure, is as follows. When stricken by intermediate gear 605 (itself stricken by hammer 603), striker 607 then, in turn, strikes firing pin 609, which may strike a loaded cartridge (not pictured) held in chamber 611, resulting, for example, in igniting an accelerant and causing a projectile within the cartridge to fire down a rifled barrel 613. Preferably, the magnetic material creating the dipole in spherical striker/gear 607, and shown by groups of negative and positive signs (discussed further, below, and such as those negative and positive signs appearing as, respectively, 610 and 614) is sorted, maintained or reinforced in its dipole position by the striking action—for example, by a heavier positive side of dipole elements.

Any number of physical and electronically mediated, systematically controlled trigger and firing mechanisms may also, or alternatively, be used, to implement various aspects of the present invention. But preferably, a mechanism, which may change the rotational position as well as horizontal and vertical position of at least the firing barrel component of the firing mechanism is used. In the preferred embodiment detailed in FIG. 6, the rotational angle of the barrel may be altered in unlimited degrees by the rotational actuation of spherical striker 607, which, owing to its electromagnetic dipole, may be rotated without structural contact by electromagnetic actuators 615, which are controlled by the control system. Actuators 615 are shown in the figure with equal net negative charges, leading to stabilizing force on the balanced (unrotated) position pictured of striker 607. Additional sensors (not pictured) may relay rotational position and/or other barrel position data, or data from which rotational position may be extrapolated, back to the system, to aid in the system's determination of rotational angle and other barrel position adjustments that will result in a point of impact of a projectile corresponding with an indicated impact position by a set Impact Point selected (given highest priority) for firing. By causing striker 607 to rotate (in any spherical rotation direction and amount of rotation dictated by the system) omnidirectionally operating gear teeth, such as those pictured as 608, of striker 607 interface with complementary omnidirectional gear teeth, such as those pictured as 606, of intermediate gear 605, the system may control and adjust the barrel rotational position by unlimited degrees, in 3 dimensions, as well as slightly shift the barrel fore and aft in the directions of its length, and move the end of the barrel upward and downward, by various degrees. As striker 608 rotates, and its teeth 608 interface with and climb the teeth 606 of intermediate gear 605, the side of the barrel proximal to hammer 603 moves horizontally, vertically and by rotational position. Servo/motor actuable (e.g., by solenoid) barrel movement pistons 617 are mounted to the body of the rifle and connect to the barrel by rotatable (preferably, hinged) bracing joints 619, which may connect with the barrel by a ring-shaped clasp 620, in which the barrel fits but, in some embodiments with fore and aft barrel movement, may slide and rotate (e.g., with the use of sprung bearings or a gasket), as necessary, fore and aft to accommodate rotational and shifting movement of the barrel, further enabling rotational and horizontal and vertical barrel movements and at least semiautomatic or bolt action chambering of new rounds using barrel recoil, gas compression, electronic actuation of actuators or manual bolt operation (each such action is not pictured). Joints 619 and clasp 620 preferably hold the barrel and/or attached chamber and firing pin and its housing from a location or point on the length of the barrel more distal from the hammer end than the spherical striker, or other rotational direction actuation driver. As another example of a rotational actuation driver, a set of two or more separately actuable pistons (not pictured), similar to pistons 617 but to the right of pistons 617, from the perspective of the figure, and also connected to a clasp by rotatable bracing joints, may drive the position of the proximal end (facing the hammer) vertically and/or horizontally in varying degrees and, in conjunction with fixation or coordinated actuation of pistons 617, may yield a wide variety of rotational, horizontal, vertical positions of the barrel, as dictated by a control unit of by the system. Another such piston may be used, but mounted for fore and aft shifting actuation of the barrel, to accomplish different fore and aft shifting of the barrel. But in combination, pistons 617 (with their slidable attachment joint 619) and spherical gear striker 607 (or the alternate piston embodiments discussed immediately above) permit the system to adjust the barrel to modify shot elevation, lateral position, and bullet path—and each of those types of movements separately or together. In this way, ballistic equations may be dealt with more easily by the system, by isolating variables for alteration, rather than with more complex ballistic equations. In the context of applying a similar mounting for 3-D photography, various angles may be acquired for a photographic subject from one lens, which may be mounted as the barrel is in this example to aid in rapidly acquiring and executing such shots. In another, simpler embodiment, but without all of the firing mechanism positioning capabilities, a single set of pistons, or other positioning actuators (such as those incorporating servo/motors and solenoids) such as those shown as 617 may be used, in conjunction with a rotatable joint, pocket, pivoting point or other physical rotation point (which need not be separately actuable by the system) may be used in place of the spherical gearing, to accomplish some rotational actuation and even some horizontal and vertical shifting of the barrel, as may be dictated by the system. A wide variety of other rotational and position actuation mechanisms and feedback, including purely electromagnetic actuation, may also be used, though the embodiments discussed are preferred due to the high cost of such purely electromagnetic actuation of all elements, given the high current cost of moving and holding heavy weapons firing components electromagnetically. In the photographic application of the invention, however, more or purely electromagnetic actuation and feedback, such as that discussed for spherical striker 607, may be preferred for all actuators.

Force-loading structure 621 connects the body of the rifle and barrel, and applies force to the barrel in the direction indicated by force-indicating arrow 622, driving and seating the barrel and connected chamber, firing pin 609 and, most immediately, spherical gear striker 607 into gear 605. Straight-line moveable, piston-action mount 605*a* connects gear 605 to the body of the rifle, providing a secure platform and also applying reacting force in the direction opposite to force arrow 622 to aid in maintaining strong gear teeth interface for gear 605 and striker 607, by pushing them together. In alternate embodiments, the hammer element may be omitted and the piston 605*a* or other striking actuator may itself provide striking force to gear 605, striker 607 and/or firing pin. In this instance, a specialized piston and actuably-rotating armature also may be used, which allows the striking force to be generated in any direction, and more perfectly oppose (be generated 180 degrees from) the barrel and chamber direction, however it may be rotationally actuated at the time of striking—moving gear 605 in a straight-line path direction perpendicular to the tangential plane at the central point of the spherical gear interface. A semi-spherical gear such as 605 with a spherical center located at the distal rotational pivot point of the barrel may, instead, be used (as pictured by alternate gear inner surface shape, teeth omitted, shown as 627), which may aid in creating even opposing force as the gear is actuated. But in that case, the capability for fore and aft shifting of the barrel during rotational actuation will be eliminated unless an additional piston or other actuator for creating for and aft shifting of the barrel and firing mechanism is used. Alternatively, or in addition, uneven gear teeth angles and thickness may be used, as pictured, to create approximately stable striking force at the point of striking, opposing the direction of the barrel and chamber, for any possible point of spherical gear interface. In any event, the system may use a final (firing strike completed) barrel position, to whatever degree the barrel may shift in each rotational position due to striking action, in determining the nature and degree of barrel position actuation to result in hitting the highest priority impact point with a shot. To allow piston 605*a* to operate at a radially-centered attachment point, hammer 603, if used, may contain a central slot or cavity, or be comprised of two striking pieces, between which such a piston is seated. If the hammer is omitted, an actuable striking force exerter may be connected directly to the barrel and/or striker and/or firing pin, and spherical gearing may be implemented without a spherical gear also serving as a striking or strike-transmission element, as it is in the figure. However, such an embodiment may be more expensive to implement, as it would require electrical or more complex mechanical striking assembly, to allow changing barrel position and still exert a sufficient striking force at all such positions.

Turning back to the embodiments shown in the figure, variable striker holders 623 may prevent firing pin actuation until a firing execution is commanded or carried out—serving as a safety and gear engagement maintenance device. For example, holders 623 may retract into pockets 624 by a system or user electronic command or actuation signal, or simply by being overcome by the force of a hammer strike from hammer 603, toward the spherical striker 607. Alternatively, as discussed above, hammer 603 may be omitted, and straight-line only movable piston mount 605*a* may itself be system- or firing movement-actuable to strike spherical striker 607 and overcome the holding force of holders 623.

Figure 7:
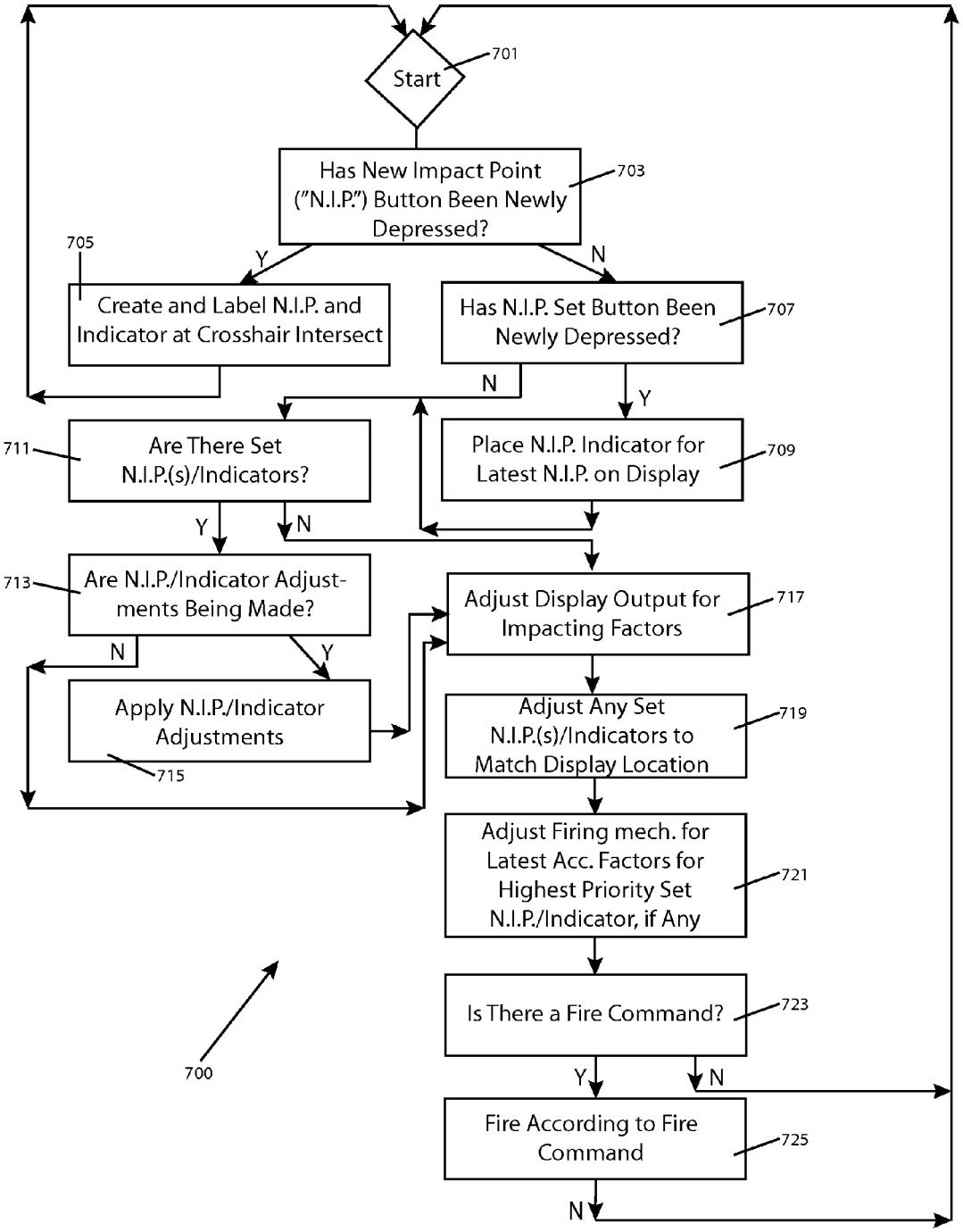
FIG. 7 is a process flow diagram for exemplary steps that may be taken by a system, such as a hardware and software system, implementing aspects of the present invention.

FIG. 7 is a process flow diagram for exemplary steps 700 that may be taken by a system, for example, a hardware and software system, such as the system discussed above with reference to FIG. 5, implementing certain user interface and display aspects of the present invention. In step 701, the process begins and proceeds to step 703, in which the system receives or consults any sensor-transmitted or stored data indicating whether a New Impact Point ("N.I.P.") button has been newly depressed (meaning that the system has not already taken action on such a depression), such as, for example, the button given as 123, 223, 323 or 423 of FIGS. 1-4. If so, the system proceeds to step 705, in which it creates a New Impact Point and indicator as discussed elsewhere in this application. As step 705 and other steps indicate, it is preferred that unless and until this N.I.P. and indicator have been "set" it remains pinned to the intersection of the crosshairs of a reticle (or otherwise in an easily-referenced user-movable position for unset N.I.P.s and indicators within a sight or display, depending on the embodiment chosen). Accordingly, after creating an N.I.P. and indicator, and placing them in the center of the crosshairs for further procedures, the system returns to the start position, 701. If at step 703, however, the system determines that the N.I.P. button has not been newly depressed, the system proceeds to step 707, in which the system receives or consults any sensor-transmitted or stored data indicating whether an N.I.P. "set" button has been newly depressed, such as, for example, the button given as 125, 225, 325 and 425 of FIGS. 1-4. If so, the system proceeds to step 709, in which the system places the N.I.P. and indicator in a set position relative to an observed or representatively displayed subject and/or subject environment and/or other surrounding environment, in the displayed output of a sight (and preferably, the last of these options, because the system may then use inertial indicators such as accelerometers only, and therefore may be cheaper and more practical for use by a sniper). To define subjects, if implemented by the system, the user and/or system may identify and/or define subject objects and/or boundaries, colors, shading, or other properties thereof—automatically, or by "painting" or otherwise marking, monitoring (e.g., by comparing live attribute data to data associated with physical models of a subject, and perspective view or other subject attribute information), tracking (same) or indicating them—as discussed elsewhere in this application. Whether or not subject definition is used, preferably, the system actively maintains the N.I.P. and indicator in the position relevant to the embodiment (again, preferably, with respect to the surrounding environment of the system), such that it represents a point of impact of a projectile if fired by the system, from the targeting sight/display perspective of a user of the system, at all times after being set, regardless of system movement, as long as the indicator remains within the view of the sight or display as it, and its matching representation, if applicable, is positioned. Also preferably, if a representative or displayed sight output is used to represent the target subject and/or environment surrounding the N.I.P. and indicator, the system also maintains an accurate representation of that environment in real time, matching the actual user and system view perspective of the actual subject and environment, and, in some embodiments, implements a margin around the N.I.P. and indicator that may be user- or system-variable. To achieve such a margin during motion of the system while still tracking that system motion with an accurate view of the target environment (matching the perspective change due to the movement), the system may increase the viewing space, magnification, or create additional viewing angles ("screens," "windows" or tabs) or change focal length and/or add magnification transitions, allowing the user to assess the system movement by changed perspective of the environmental representation, while maintaining a relative indication of the position of the set N.I.P. and indicator. Prior to setting an N.I.P. and indicator, however, in any embodiment's environmental view, changes to match the actual or selected user and/or system view perspective of a subject and/or environment would be made. Also preferably, adjustments to the firing mechanism are also made in real time, to maintain a point of impact of a projectile, if fired, coinciding with the location of an N.I.P. and indicator assigned the highest priority for firing, by the user or system. Rather than have real-time adjustments to the firing mechanism, environmental perspective and set N.I.P. and indicator displayed, however, the system may periodically correct the environmental and/or subject view perspective displayed, and the displayed set N.I.P. location, as will be discussed in greater detail below.

If the system has placed a set N.I.P. indicator for the latest set N.I.P. on the display within a view or representation of the target environment in the sight, according to step 709, or, instead, determined that the N.I.P. "set" button was not depressed, the system may proceed to step 711. In step 711, the system determines whether any N.I.P. indicators have been set by the system, including such indicators that may have been set prior to the possible instance discussed above. If so, the system may proceed to step 713, in which it determines whether N.I.P. adjustments are to be made, for example, based on user input adjusting the position of a set N.I.P., such as by horizontal and vertical position adjusting knobs 247 and 245, from FIG. 2, which may also be axially depressible such that a user may toggle between set N.I.P.s and indicators for adjustment and priority rearrangement, which may also be by separate controls. If such adjustments are being made, the system implements such adjustments by moving the relative position or altering the priority of the N.I.P.(s) selected for adjustment (which may also or alternatively be by any other practical method of object selection and movement in G.U.I.s). Whether or not adjustments have been implemented, the system then proceeds to step 717, in which the system may adjust display output to accommodate any shift in position, range, magnification, perspective, settings, sight movement, or any other factor impacting the accuracy or usefulness of representation of the targeting subject and/or target-surrounding environment represented by the display, relative to the viewer's or system's perspective. The system then proceeds to step 719, in which it further determines and implements necessary adjustments to represent the N.I.P. by an indicator in the set location for any set Impact Point within that environment or relative to a targeting subject. As mentioned above, various additional techniques may be implemented to maintain a representative view or other awareness of the targeting subject location, target-surrounding environment and a view of the N.I.P. and indicator.

The system then proceeds to step 721, in which it determines and implements necessary adjustments, as discussed elsewhere in this application, to the firing mechanism such that a projectile fired from the firing mechanism will place a projectile on, or as near as possible to on, the location of any set N.I.P. and indicator with the highest priority within the surrounding environment. If there is no currently set N.I.P. and indicator, the system may treat the intersection of the crosshairs or other reticle or impact point display point, as a set N.I.P. and indicator with the highest priority, and implement the adjustments to the firing mechanism discussed immediately above, with respect to step 721. The system then proceeds to step 723, in which it determines whether a firing command has been given by the system or user. If so, the system causes the firing mechanism to fire. If not, the system returns to the starting position.

I claim:

1. A system comprising hardware:

configured for a user to place an impact point indicator within a sight or display indicating an executable point of impact of a projectile on a target;

configured to fire said projectile within a target-surrounding environment;

configured to display said impact point indicator to the user within a context of said surrounding environment, or an at least partial representation of said surrounding environment;

configured to allow the user to cancel or alter the location of said impact point indicator within said context of said surrounding environment or said representation of said surrounding environment; and configured to counteract, in real time, the influence of sight movement, firing mechanism movement, barrel movement, display movement or system part movement, to maintain the location of the impact point indicator within said surrounding environment or said representation of said surrounding environment and to maintain a potential projectile flight path corresponding with said executable point of impact of a projectile on a target indicated by the impact point indicator.

2. The system of claim 1, in which said sight or display comprises a collimator sight including an electrically- or light-actuated display capable of presenting said impact point indicator.

3. The system of claim 1, in which said impact point indicator comprises a central point or dot.

4. The system of claim 1, in which said impact point indicator comprises an indicator surrounding or near an indicated point of impact, but which does not block the user's view of the point of impact.

5. The system of claim 1, wherein the system is configured to create more than one impact point indicator, and to set a highest priority impact point Indicator corresponding with a point of impact of a projectile on a target to be first fired upon by the system in the event of a firing command;

wherein the system is configured to counteract, in real time, the influence of sight movement or display movement to maintain the placed location of all impact point indicators within said surrounding environment or said representation of said surrounding environment; and wherein the system is configured to counteract, in real time, the influence of firing mechanism movement, barrel movement or system part movement in order to maintain a potential projectile flight path corresponding with an impact point indicated by the highest priority impact point indicator.

6. The system of claim 1, wherein the system is configured to enable the user to place an impact point indicator by a gesture including depressing a button or partially pulling a trigger.

7. The system of claim 1, wherein the system is configured to enable the user to execute an impact point indicator by a gesture.

8. The system of claim 1, in which the system further addresses, counteracts or intercepts the influence or projected influence of additional ballistics- or powered-flight- or target location-impacting factors to maintain a projectile flight path corresponding with the point of impact of a projectile on a target indicated by the impact point indicator.

9. The system of claim 1, in which the system is configured to enable a user to cancel and place another impact point indicator within said sight or display corresponding with a point of impact of a projectile on a target.

10. The system of claim 1, in which the system is configured to enable a user to adjust the position of said impact point indicator within said sight or display indicating a point of impact of a projectile on a target.

11. A system comprising hardware that is configured to, or that is configured to enable a user to:

a. create at least one impact point indicator within a sight or display, b. set the location of said at least one impact point indicator within said sight or display to correspond with a point of impact of a projectile which the system is configured to fire on a target within a target-surrounding environment;

c. cancel or adjust said set location of said at least one impact point indicator to correspond with a new or additional point(s) of impact of a projectile on a target; and d. execute a firing command resulting in firing a projectile on or near said point of impact of a projectile or said new or additional point(s) of impact of a projectile on a target;

wherein the system addresses or counteracts the movement of said sight or display relative to a target and user- or target-surrounding environment to maintain a user's viewing perspective of a target or impact point indicator or target-surrounding environment; and wherein the system further addresses or counteracts movement of a firing mechanism or barrel, or addresses or counteracts changed ballistics- or powered-flight- or location-impacting factors to maintain a point of impact for a projectile fired from said firing mechanism or barrel to correspond with the location of said at least one impact point indicator's indicated location.

12. The system of claim 11, in which said impact point indicator comprises a central point or dot.

13. The system of claim 11, in which said impact point indicator comprises an indicator surrounding or near an indicated point of impact, but which does not block the user's view of the point of impact.

14. The system of claim 11, wherein the system is configured to enable the user to create an impact point indicator by a gesture, wherein said gesture comprises depressing a button or partially pulling a trigger.

15. The system of claim 11, wherein the system is configured to enable the user to set an impact point indicator by a gesture.

16. The system of claim 11, wherein the system is configured to enable the user to execute a firing command related to an impact point indicator by a gesture.

* * * * *